United States Patent [19]

Matsumoto et al.

[11] Patent Number: 4,751,484

[45] Date of Patent: Jun. 14, 1988

[54] DRUM UNIT EXCHANGE TIME INDICATING DEVICE FOR IMAGE FORMING APPARATUS

[75] Inventors: Hideki Matsumoto, Matsubara; Shigeo Koyama, Ibaraki; Hiroshi Kusumoto, Wakayama; Yoshizo Kawamori, Fujiidera; Satoshi Uemori, Nara, all of Japan

[73] Assignee: Mita Industrial Co., Ltd., Osaka, Japan

[21] Appl. No.: 21,265

[22] Filed: Mar. 3, 1987

[30] Foreign Application Priority Data

Mar. 11, 1986 [JP] Japan ..... 61-54102

[51] Int. Cl.[4] ..... G03G 15/00

[52] U.S. Cl. ..... 355/14 CU; 355/3 DR; 355/14 SH

[58] Field of Search ..... 355/3 DR, 3 DD, 3 R, 355/14 C, 14 CU, 14 R, 14 SH

[56] References Cited

U.S. PATENT DOCUMENTS

| | | | |
|---|---|---|---|
| 3,698,805 | 10/1972 | Hickey et al. | 355/14 CU |
| 4,436,414 | 3/1984 | Kamiyama et al. | 355/3 DD X |
| 4,496,237 | 1/1985 | Schron | 355/14 C |
| 4,551,000 | 11/1985 | Kanemitsu et al. | 355/3 DR X |
| 4,563,079 | 1/1986 | Inuzuka et al. | 355/14 R |

FOREIGN PATENT DOCUMENTS

| | | | |
|---|---|---|---|
| 3184 | 1/1986 | Japan | 355/15 |

*Primary Examiner*—A. T. Grimley
*Assistant Examiner*—Ed Pipala
*Attorney, Agent, or Firm*—Koda and Androlia

[57] ABSTRACT

A drum unit exchange time indicating device for image forming apparatus comprises, an integrated signal output means to give output of integrated signal added up according to the time of use of the drum unit, a life signal output means to give output of drum unit life signal when said integrated signal exceeds predetermined value and a paper-feed mode changing means to change the mode of paper-feeding into an extraordinary mode when said drum unit life signal is detected.

7 Claims, 5 Drawing Sheets

DRUM UNIT EXCHANGE TIME INDICATING DEVICE FOR IMAGE FORMING APPARATUS

BACKGROUND OF THE INVENTION

1. Field of the Invention

The present invention relates to a device for indicating the exchange time of the drum unit used for image forming apparatus.

2. Description of the Prior Art

In the cleaning process of electrophotography applied to such apparatus as copying machines and laser printers, it is so arranged that the toner remaining on the surface of the photosensitive drum (hereinafter referred to as drum) is scraped off with blades of a cleaning device and is recovered into a waste toner tank.

It is, therefore, necessary to discard the waste toner when the waste toner tank is filled fully with recovered waste toner.

While the cleaning blades used for the cleaning process have a limitation on the usable life because of wear due to continuous use.

Life of the drum itself is also limited as the sensitivity is lowered and the charging property is deteriorated through continuous use.

Under the situation, an increasing number of image forming apparatus are made to the type for which the drum of a limited life, the cleaning blades, and the waste toner tank that needs periodical discharging of the waste toner are integrated into a drum unit, and the drum unit is assembled into the image forming apparatus for easier maintenance.

For the image forming apparatus of this type, therefore, the whole drum unit is to be exchanged at certain time to maintain the performance.

In an image forming apparatus, for example, the drum unit is replaced when the waste toner tank is filled with waste toner up to certain level regarding the time as the life of the drum unit. As the means to indicate the time of replacement, the system in which further printing is disabled so that the operator is forced to change the drum unit is employed.

This system, however, is very inconvenient for the operator as printing is disabled all of a sudden and exchanging is impossible without a spare drum unit.

By the apparatus disclosed in U.S. Pat. No. 4,551,000, as another example, the drum unit is to be exchanged when drum revolution reaches certain limit, and as the means to indicate the time of exchange, it is proposed to turn a color coded disc or to glow a lamp.

As this arrangement, however, is merely to indicate the life of the drum unit, printing is continued by the operator regardless of the indication in most cases, which allows possibility of later troubles.

SUMMARY OF THE INVENTION

It is the general object of the present invention to provide a device for indicating the exchange time of the drum unit used for image forming apparatus by such arrangement that the condition of paper feeding is changed when useful life of the drum or of the drum unit comes to an end while keeping printing operation still possible so that the operator can see the change and replace the drum unit.

More specifically, it is the primary object of the present invention to provide a device for indicating the exchange time of the drum unit used for image forming apparatus comprising an integrated signal output means to give output of integrated signal added up the time of use of the drum unit according to extent of use, a life signal output means to give output of drum unit life signal when the integrated signal exceeds a preset level, and a paper-feed mode changing means to change the mode of paper-feed into an extraordinary mode when the drum unit life signal is detected.

DETAILED DESCRIPTION OF PREFERRED EMBODIMENTS

Figure 1:
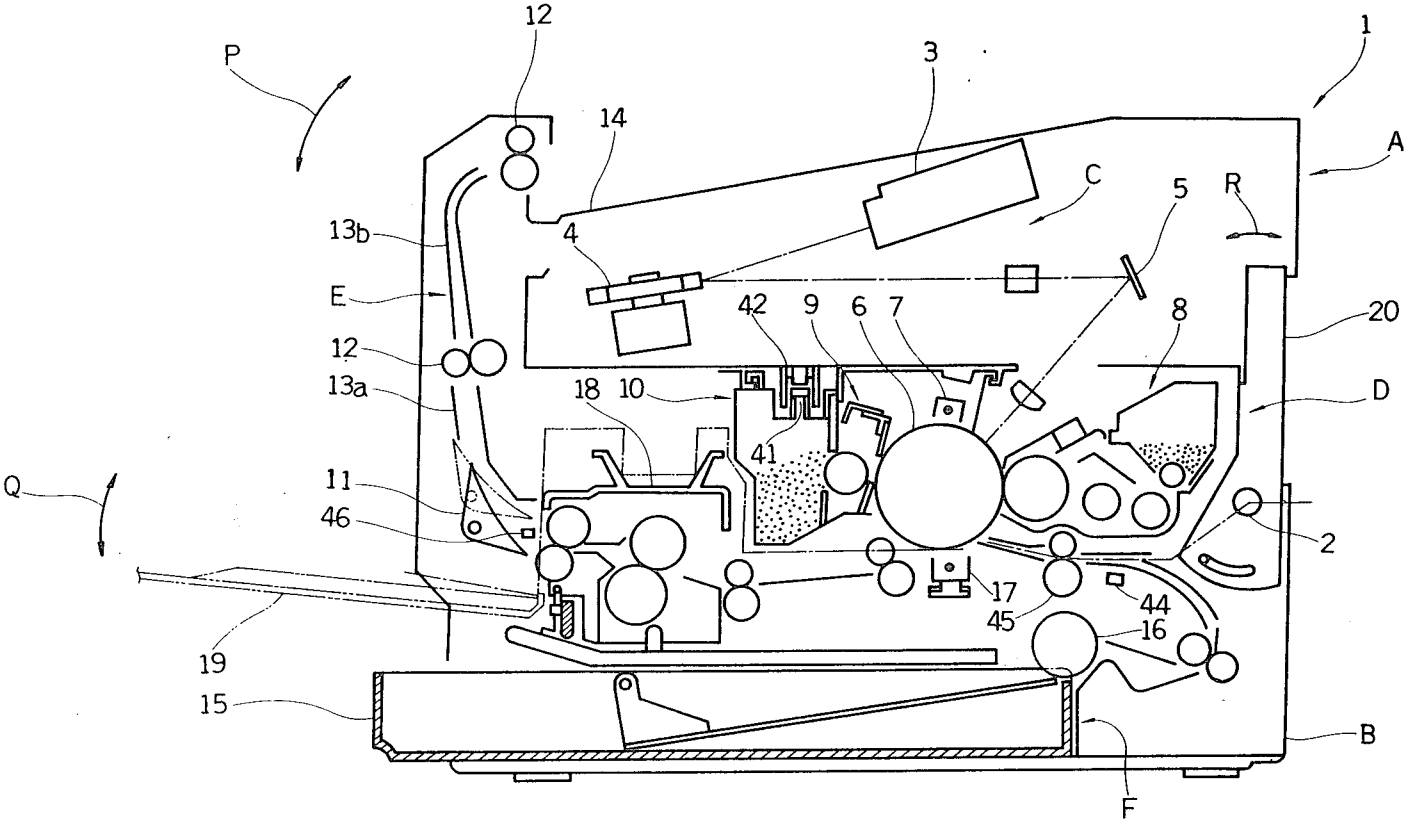
FIG. 1 is a sectional view of an image forming apparatus (laser printer) including an embodiment of the drum unit exchange time indicating device according to the present invention.

A laser printer 1 shown in FIG. 1 comprises an upper unit A which can be turned in the direction of arrow P around pivot 2 and a lower unit B and is composed to so called clam shell type.

Such devices are provided in the upper unit A as a laser optical unit C which comprises a laser transmitter 3 to give output according to the signals received from an image signal input device not shown in the drawing, a rotary mirror 4, a reflection mirror 5 and so on; an image forming unit D which comprises a drum 6, a charging device 7 provided near the drum 6, a developing device 8, a cleaning device 9, a waste toner tank 10 and so on; and an upper paper discharge unit E which is composed of a paper route switching device 11, a pair of rollers 12, guides 13*a*, 13*b* and so forth. 14 is an upper paper receiving tray, 20 is a manual paper-feeding unit which can turn in the direction of arrow R around the above mentioned pivot 2, and 46 is a discharged paper sensing switch.

Provided in the lower unit B are such devices as a paper-feed unit F comprising a paper-feed cassette 15, a paper-feed roller 16, a timing switch 44 for sensing paper supplied, a timing roller 45 provided before the timing switch 44 and functions for timing the operation to the drum 6 and so on; an image transfer unit 17 provided near the drum 6, and a fixing device 18. 19 is a paper receiving tray which can be folded or extended freely in the direction of arrow Q.

As shown in detail in the right half of FIG. 2, the developing device 8 is so composed as described below. 22 is a developer tank to keep developer 23 made of toner and carrier, and an opening 24 is made facing to the drum 6, and a developing sleeve 25 made of non-magnetic material is provided at the opening 24 in such a manner that the axial center is kept parallel to the rotary axis of the drum 6. A magnet 26 is kept stationary in the developing sleeve 25.

27 is a replenishment toner tank provided at the upper side of the developer tank 22 in such a manner as to come in connection with the developer tank 22 through an opening 28, and a toner supply roller 29 is disposed at the upper side of the opening 28 (the side of replenishment toner tank 27).

The toner supply roller 29 is made of sponge, for example, having a number of grooves on the periphery and is so composed to be turned at a specified rate by a motor not shown in the drawing. As the toner supply roller 29 turns, toner 31 staying in the grooves are squeezed off by the edge of the opening 28 and a specified quantity of toner 31 in the replenishment toner tank 27 is supplied to the developer tank 22.

32 is an agitator to stir the developer 23 and the toner 31 supplied through the opening 28 and to supply the mixture to the developing sleeve 25 and is so arranged to turn around the axial center which is parallel to the rotary axis of the developing sleeve 25.

33 is a cut-off plate to cut-off excessive developer 23 on the top of the magnetic brush on the developing sleeve 25 and coming up as the developing sleeve 25 turns.

34 is a distribution plate and is corrugated diagonally so that the developer 23 after cut-off flow down while being shifted to one side of the rotary axis of the agitator 32.

35 is a spiral member to transfer the developer 23 flowed down while being shifted to one side of the rotary axis of the agitator 32 in opposite direction this time to the other side of the rotary axis of the agitator 32, and is so arranged as to turn around the axial center which is parallel to the rotary axis of the agitator 32.

36 is a toner density detect sensor attached to the tank 22 near the cut-off plate 33 and functions to detect lowered density of the toner in the developer tank 22 and to give output of a specified signal. According to the signal, the motor not illustrated turns the toner supply roller 29, and a specified quantity of toner 31 is supplied into the developer tank 22 through the opening 28 as described above.

Figure 2:
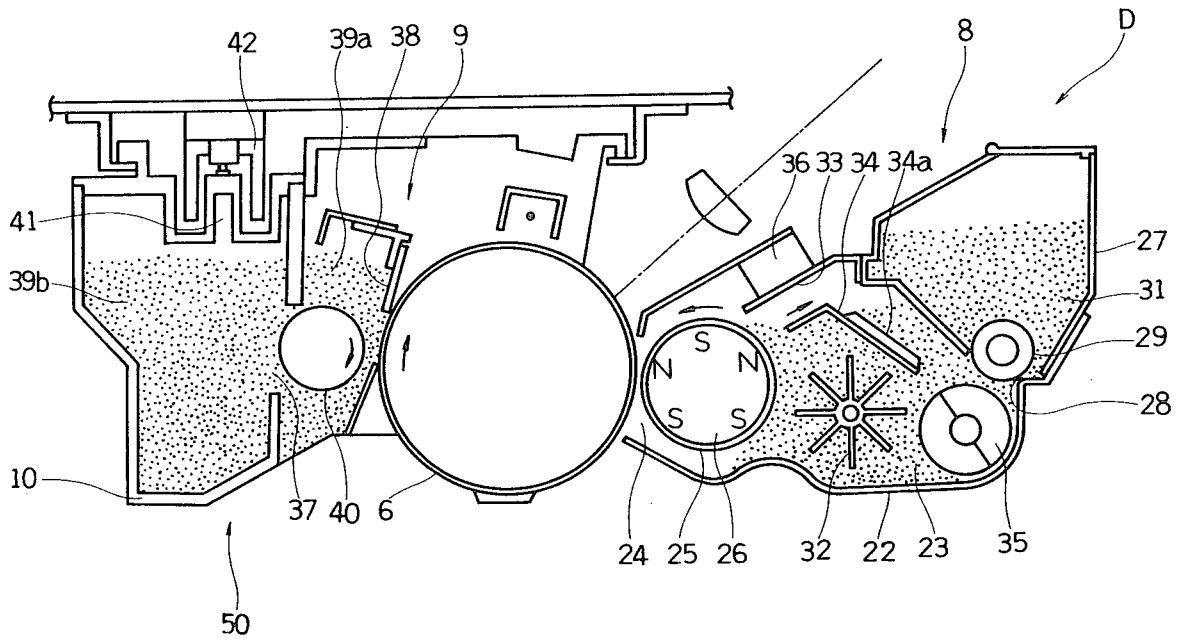
FIG. 2 is a sectional view showing the main part of the image forming apparatus shown in FIG. 1.

While, as shown in detail in the left half of FIG. 2, the waste toner tank 10 is provided in such a manner as to come in connection with the cleaning device 9 through an opening 37.

A sponge roller 40 to discharge waste toner **39*a* scratched off by a blade 38 to the side of the waste toner tank 10 is provided at the side of the cleaning device 9 of the opening 37 in a manner as to turn around the axial center which is parallel to the rotary axis of the drum 6**.

A toner overflow sensor 42 made of, for example, a photocoupler is provided at the outside of a pit 41 at the upper part of the waste toner tank 10.

The toner overflow sensor 42 functions to detect increase of the waste toner **39*b* in the waste toner tank 10 reaching to the pit 41** and to give output of a specified signal, i.e. drum unit life signal.

The waste toner tank 10 and the drum 6 are composed to an integral unit as drum unit 50. Accordingly, the laser printer 1 allows easy exchange of the drum unit 50 as required.

Figure 3:
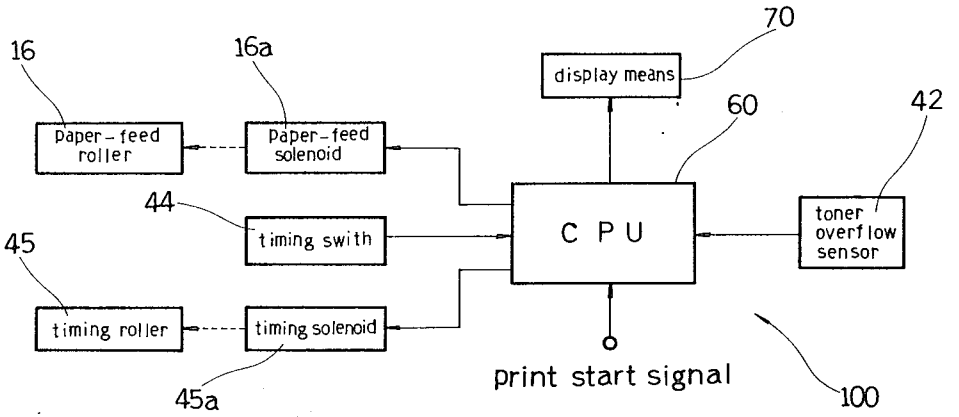
FIG. 3 is a block diagram of an embodiment of the present invention.
Figure 4:
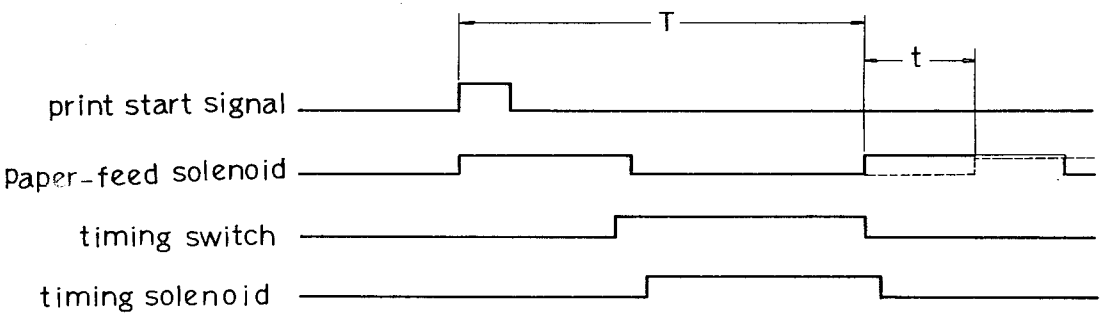
FIG. 4 is a timing chart of various kinds of signals when paper-feed timing is delayed.

Referring now to FIG. 3 and FIG. 4, an operation of a drum unit exchange time indicating device 100 of an embodiment of the present invention will be described hereinafter.

(1) Pushing a print button on an operation panel not illustrated gives input of a print start signal to a C.P.U. 60.

(2) A paper-feed solenoid **16*a* is driven based on the print start signal, the paper-feed roller 16** turns for predetermined time, then paper-feeding starts.

(3) When the timing switch 44 is pushed by the top end of a sheet of paper, driving of the paper-feed solenoid **16*a* comes to a stop after predetermined time. During the time, the top end of paper reaches the timing roller 45**.

(4) Based on a signal from the C.P.U. 60, the timing solenoid **45*a* is driven, then the timing roller 45 turns and the paper is carried toward the drum 6**.

(5) Under ordinary condition of no input of drum unit life signal into the C.P.U. 60 and under the mode of continuous printing, the paper-feed solenoid **16*a* is immediately driven to feed the next paper when rear end of the paper goes out of the timing switch 44**.

If the interval of paper-feed is T (min.) in this case, the number of sheets of paper supplied per minute is 1/T (sheets/min.). In other words, the printing speed is 1/T (sheets/min.) as the number of sheets of paper supplied per minute is equal to the number of sheets printed per minute, i.e. printing speed.

As a specific example, $T=5$ (sec.) and the printing speed is 12 (sheets/min.) if the paper size is $8\text{-}\frac{1}{2}\times 11$.

(6) Input of drum unit life signal is given to the C.P.U. 60 when waste toner **39*b* in the waste toner tank 10 increases and reaching to a specified level, i.e. to the pit 41 is detected by the toner overflow sensor 42**.

Then the C.P.U. 60 does not drive the paper feed solenoid **16*a* even when rear end of the paper goes off the timing switch 44, but the software timer incorporated in the C.P.U. 60** is driven.

Driving of the software timer comes to an end in t seconds, then the paper-feed solenoid **16*a*** is driven.

Accordingly, the printing speed is $1/(T+t)$ (sheets/min.) because the operation timing of the paper-feed solenoid **16*a* is delayed by t later than the timing of ordinary condition as shown in FIG. 4**.

As a specific example, $T=5$ (sec.), $t=15$ (sec.) and the printing speed is 3 (sheets/min.).

(7) Thus, according to the exchange time indicating device 100, the operator can know the change in the interval of printed paper discharged to the paper receiving tray 19 clearly by seeing or hearing and can exactly recognize that the time to exchange the drum unit 50 has come.

Although the printing speed is lowered, inconvenience is not very serious as printing does not stop.

(8) It is better to use an alarm indication on a display means 70.

A variation of the embodiment is the type in which the number of input times of ON signal of the timing switch 44 (number of times of printing) is counted at the C.P.U. 60 and drum unit life signal is generated in the C.P.U. 60 when the count exceeds a preset number, instead of using the toner overflow sensor 42.

Figure 5:
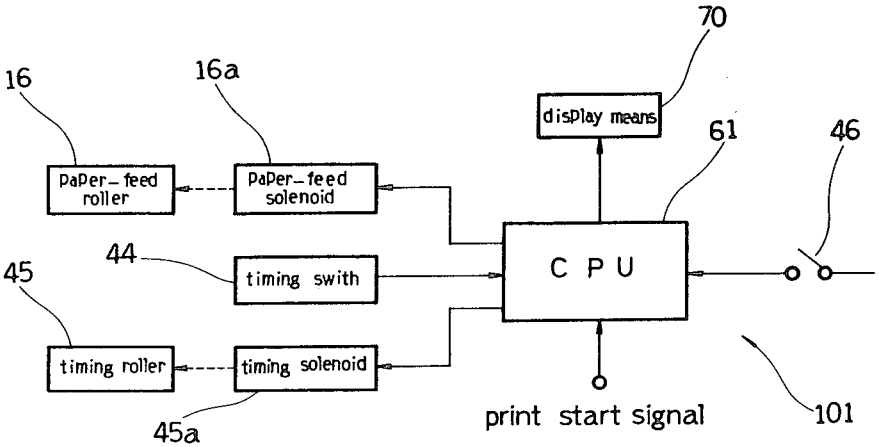
FIG. 5 shows a block diagram of another embodiment of the present invention.

Another embodiment is the device 101 shown in FIG. 5. A C.P.U. 61 has a computing program to calculate a time of paper going past the discharged paper sensing switch 46 by receiving ON signal from the discharged paper sensing switch 46 disposed at the paper discharge side of the fixing device 18, an integrating program to add up the calculated values, a comparison program to generate drum unit life signal when the total value reaches predetermined level, and a converting program to convert the integrated values into the number of sheets of the standard paper.

Designated by 70 is an display means to indicate the converted number of sheets to outside and can be, for example, an electronic indicator of segment type or a counter of mechanical type. It may be mounted onto the drum unit 50, or the operation panel not illustrated, or onto both the drum unit 50 and the operation panel.

An operation sequence is as described below.

(1) Pushing of the print button not illustrated gives input of print start signal into the C.P.U. 61.

(2) Printing starts according to the print start signal, printed paper goes through the fixing device 18, and the paper top turns ON the discharged paper sensing switch 46.

(3) The discharged paper sensing switch 46 is turned OFF when the paper goes through and the rear ends goes off the discharged paper sensing switch 46.

Input of the ON and OFF signals are given into the C.P.U. 61, which calculate passing time of the paper according to the above mentioned computing program.

(4) By repeating the above procedure (2) and (3), the C.P.U. 61 calculates the passing time of each sheet of paper, and the calculated values are added up by the integrating program.

(5) The comparison program generates drum unit life signal when the integrated value exceed a specified time.

(6) While the converting program convert the integrated value into the number of sheets of standard paper (8-½×11 size paper for example), and the converted value is indicated by the above mentioned display means 70.

By this device 101, the passing time of discharged paper i.e. the time actually used by the drum unit 50 for printing is calculated for life detection of the drum unit 50. Accordingly, judgement of life time can be accurate.

As an advantage, the time to exchange the drum unit 50 can be known without fail when the result of conversion is arranged to be indicated by the display means 70 attached to the drum unit 50.

Figure 6:
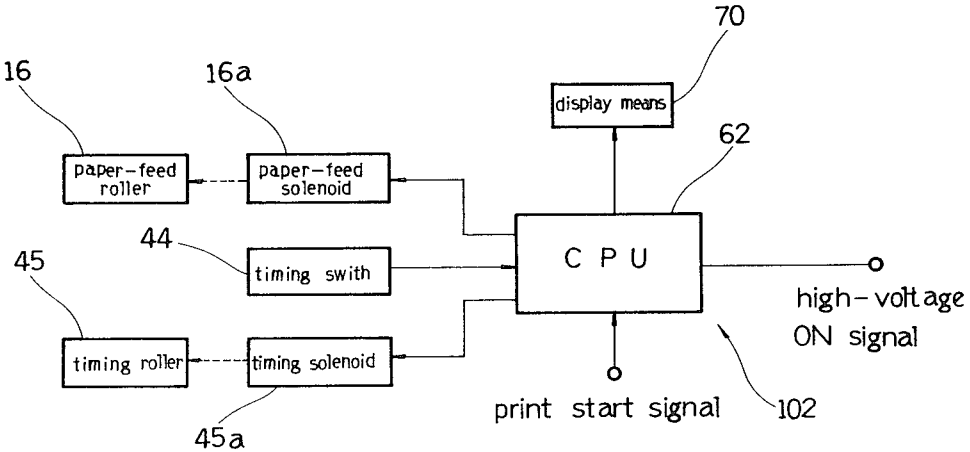
FIG. 6 shows a block diagram of a further embodiment of the present invention.

The device 102 shown in FIG. 6 is a further embodiment. A C.P.U. 62 has a computing program to calculate a time from high-voltage ON to OFF of the charging device 7, an integrating program to add up the calculated values, a comparing program to transmits drum unit life signal when the integrated value reaches a specified level, and a converting program to convert the integrated value into the number of sheets of standard paper.

An operating sequence is as described below.

(1) Pushing the print button not illustrated gives input of print start signal to the C.P.U. 62.

(2) The paper-feed solenoid **16*a* is driven according to the print start signal to turn the paper-feed roller 16** for a specified time, and primary paper-feeding starts.

(3) High-voltage is applied to the charging device 7 in certain time after pushing the print button. When high-voltage is turned ON, the computing program starts calculating the time of high-voltage application.

(4) After the primary paper-feeding, the timing solenoid **45*a* operates to turn the timing roller 45** and the secondary paper-feeding starts. Then application of high-voltage completes. The time of high-voltage application to OFF is calculated by the computing program.

(5) The C.P.U. 62 calculates the time of high-voltage application for printing by repeating the procedure (2) to (4), and the calculated time is integrated by the integrating program.

(6) The comparing program generates drum unit life signal when the integrated value exceeds a specified time.

(7) While the converting program converts the integrated time into the number of sheets of standard paper, and the converted number is indicated by the above mentioned display means 70.

By the device 102, the time of high-voltage application to the charging unit 7, i.e. the time actually used by the drum unit 50 for printing is calculated for life detection of the drum unit 50. Accordingly, judgement of the life can be accurate.

Figure 7:
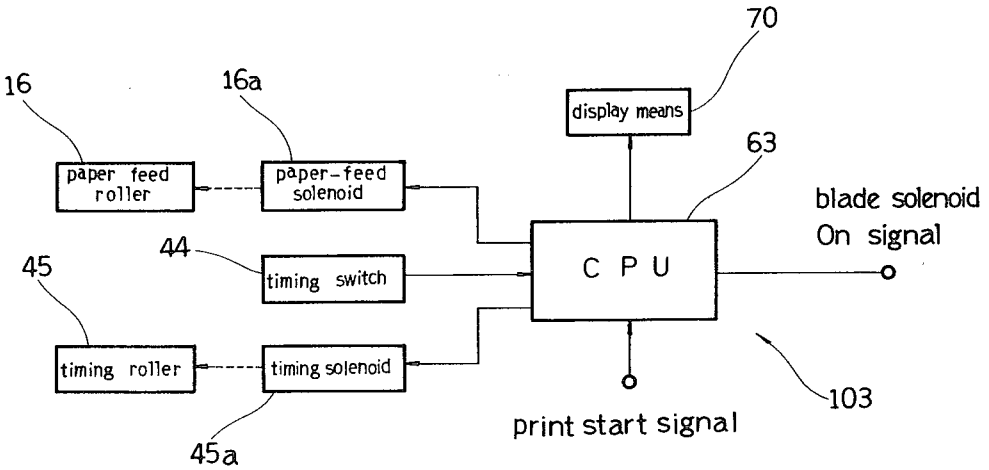
FIG. 7 is a block diagram of still other embodiment of the present invention.

Still other embodiment is the device 103 shown in FIG. 7. A C.P.U. 63 has a computing program to calculate a time from the blade 38 ON to OFF, an integrating program to add up the calculated values, a comparing program to generate drum unit life signal when the integrated value reaches a specified level, and a converting program to convert the integrated value into the number of sheets of standard paper.

An operating sequence is as described below.

(1) Pushing the print button not illustrated performs printing and the blade solenoid **45*a* to operate the blade 38 of the cleaning device 9** is turned ON.

(2) When printing completes, the blade solenoid **45*a*** turns to OFF.

(3) Blade ON time by every printing is calculated by the computing program.

(4) Blade ON time is added up by the integrating program.

(5) The comparing program generates drum unit life signal when the integrated time exceeds a specified time.

(6) While the integrated time is converted by the converting program into the number of sheets of standard paper, and the converted number of sheets is indicated by the display means 70.

By the device 103, judgement of drum unit life can be exact because usable life of the drum unit 50 is detected by operating time of the blade 38 of the cleaning device 9, i.e. by calculating the time used by the drum unit 50 for printing.

Still further embodiment is the type to make printing speed itself slower than usual based on drum unit life signal.

In the above descriptions of several embodiments, the laser printer is used as an example of image forming apparatus. It is particularly understood that the invention is not limited thereto or thereby but is also applicable to copying machines in general.

As is known from the above description, the present invention serves for accurate detection of usable life of the drum unit, yet printing itself can be continued even when drum unit life signal is given but the mode of paper-feed is changed to inform the operator that the life is coming to the end. Practically, it is very convenient, therefore, and the drum unit can be changed at an adequate time. There is no worry of causing various kinds of troubles later because printing is not continued in ordinary condition.

What is claimed is:

1. A drum unit exchange time indicating device for image forming apparatus comprising:

an integrated signal output means to give output of integrated signal added up according to the time of use of the drum unit;

a life signal output means to give output of drum unit life signal when said integrated signal exceeds a predetermined value; and a paper-feed mode changing means to change the mode of paper-feeding into an extraordinary mode when said drum unit life signal is detected, the paper feed mode changing means being so composed that printing speed is made slower than the printing speed under ordinary paper-feed mode when the drum unit life signal is detected.

2. A device according to claim 1, wherein the integrated signal output means and the life signal output means are comprised of a waste toner quantity sensing means disposed at a predetermined position of the waste toner tank, and said drum unit life signal is generated when waste toner in the waste toner tank goes over a specified level.

3. A device according to claim 1, wherein the integrated signal output means is a print number counter means, the life signal output means is a comparator means, and said drum unit life signal is generated when number of times of printing exceeds a specified number.

4. A device according to claim 1, wherein the integrated signal output means is an integrator means to measure the time of paper going through and to total the measured results, the life signal output means is a comparator means, and said drum unit life signal is generated when total value of paper passing time exceeds a specified time.

5. A device according to claim 1, wherein the integrated signal output means is an integrator means to measure the time of high-voltage applied to the main charging device and to total the measured results, the life signal output means is a comparator means, and said drum unit life signal is generated when total of high-voltage applied time exceeds a specified value.

6. A device according to claim 1, wherein the integrated signal output means is an integrator means to measure operating time of the blade of the cleaning device and to total the measured results, the life signal output means is a comparator means, and said drum unit life signal is generated when total of blade operating time exceeds a specified time.

7. A drum unit exchange time indicating device for image forming apparatus comprising:

an integrated signal output means to output an integrated signal added up according to the time of use of the drum;

a life signal output means to output a drum unit life signal when said integrated signal exceeds a predetermined value; and a paper-feed mode changing means to change the mode of paper-feeding into an extraordinary mode when said drum unit life signal is detected, said paper-feed mode changing means being so composed that the paper-feed timing in the case of continuous printing is more delayed than the timing of ordinary paper-feed mode when the drum unit life signal is detected.

* * * * *